United States Patent [19]

Hull et al.

[11] 4,110,504

[45] * Aug. 29, 1978

[54] SELF-SANITIZING CARPET CONSTRUCTION COMPOSITION

[75] Inventors: Ezekiel H. Hull; Robert H. McIntosh, both of Greensboro, N.C.

[73] Assignee: Anthony B. Askew, Atlanta, Ga.

[ * ] Notice: The portion of the term of this patent subsequent to Dec. 5, 1989, has been disclaimed.

[21] Appl. No.: 696,219

[22] Filed: Jun. 15, 1976

Related U.S. Application Data

[60] Continuation of Ser. No. 571,717, Apr. 25, 1975, abandoned, which is a continuation-in-part of Ser. No. 478,109, Jun. 10, 1974, Pat. No. 3,919,410, which is a continuation of Ser. No. 292,792, Sep. 27, 1972, abandoned, which is a division of Ser. No. 139,265, Apr. 30, 1971, Pat. No. 3,705,235.

[51] Int. Cl.[2] ..... D03D 27/00

[52] U.S. Cl. ..... 428/97; 428/95

[58] Field of Search ..... 428/85, 95, 97; 424/78, 424/83, 315

[56] References Cited

U.S. PATENT DOCUMENTS

| | | | |
|---|---|---|---|
| 3,705,235 | 12/1972 | McIntosh | 424/83 |
| 3,919,410 | 11/1975 | McIntosh | 424/315 |
| 3,920,836 | 11/1975 | McIntosh | 428/315 |
| 3,928,563 | 12/1975 | McIntosh | 424/78 |

*Primary Examiner*—Marion E. McCamish
*Attorney, Agent, or Firm*—Jones, Thomas & Askew

[57] ABSTRACT

Conventional tufted carpet floor covering includes a self-sanitizing additive intimately mixed with the liquid carpet construction composition which binds the tuft loops in place in the primary backing. The self-sanitizing additive is a mixture of a nonionic trialkylamine and a Group II-A or Group II-B metal salt of a monocarboxylic acid having a carbon chain length of 1 to 4.

3 Claims, 3 Drawing Figures

SELF-SANITIZING CARPET CONSTRUCTION COMPOSITION

CROSS-REFERENCE TO RELATED APPLICATIONS

This application is a continuation of application Ser. No. 571,717, filed Apr. 25, 1975, now abandoned, which in turn is a continuation-in-part of application Ser. No. 478,109, filed June 10, 1974, now U.S. Pat. No. 3,919,410, which was a continuation of application Ser. No. 292,792 filed Sept. 27, 1972, not abandoned, which was a division of application Ser. No. 139,265 filed Apr. 30, 1971, now U.S. Pat. No. 3,705,235.

The present invention relates to a self-sanitizing carpet construction composition and its use in the construction of a tufted carpet floor covering material. More particularly, the present invention relates to the use of a particular self-sanitizing additive in a conventional back coating composition for tufted carpet floor covering products.

Tufted carpet floor covering materials are conventionally constructed by stitching carpet yarn into a loosely woven sheet of material normally referred to as the primary carpet backing material. This material is normally woven from natural materials such as jute and synthetic materials such as polypropylene and polyethylene. Following stitching of the carpet yarn into the primary backing the product has an upper surface with a face of carpet yarn and an undersurface with rows of tuft loop backs of carpet yarn. In order to secure the carpet yarn in place in the primary backing a layer of carpet construction back coating adhesive is then spread over the loop backs. This adhesive serves to secure the yarn in place within the primary backing. In some forms of carpet construction a second woven layer of material is then placed on top of the layer of back coating adhesive to finish the carpet product. This second woven layer is conventionally referred to as the secondary backing. In other forms of carpet construction the back coating adhesive is spread on the undersurface of the carpet product in sufficient quantities to adhere the loops of carpet yarn in place and provide an integral secondary backing. Often in these forms of construction the layer of back coating adhesive is foamed to provide an additional cushion effect. In still other forms of construction a layer of foam material is placed on top of the layer of back coating adhesive to finish the carpet product. The common feature of all forms of tufted carpet is the use of a carpet construction composition to secure the tuft loops in place and optionally secure additional layers of other materials to the carpet product.

Conventional tufted carpet floor covering materials would be desirable for use in hospitals and other similar facilities because of the inherent sound deadening features of tufted carpet and also the attractive appearance and ease of maintenance for such floor coverings. However, tufted floor covering materials have found very little use in hospitals and other such facilities because the face yarn provides a breeding area and haven for infectious bacteria and other harmful organisms. It has been found that conventional carpet cleaning equipment does not adequately destroy and remove these organisms. As a result tufted floor covering materials have become quite unsanitary, by hospital standards, soon after installed and therefore unsuitable for use.

It is an object of the present invention to provide a self-sanitizing carpet construction composition which when used in the contruction of tufted carpet will produce a product which is self-sanitizing and therefore useful in hospital and similar type applications.

This and other objects, features and advantages of the present invention will become apparent from reviewing the following description taken in conjunction with the accompanying drawings wherein.

Figure 1:
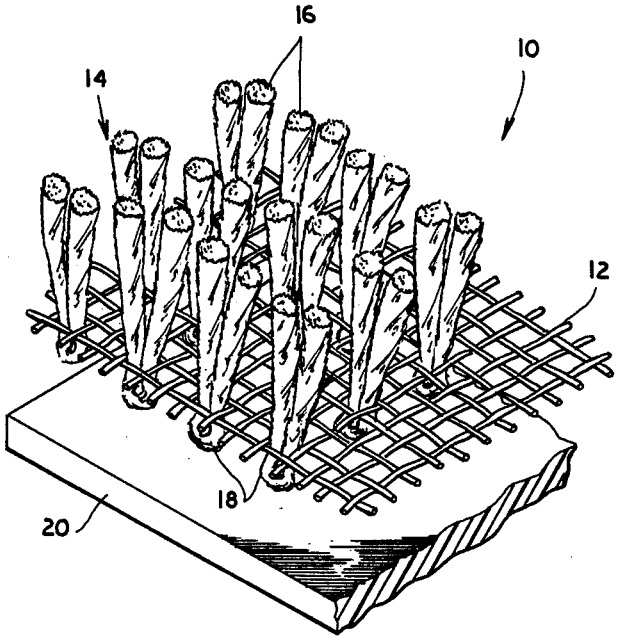
FIG. 1 is an enlarged and slightly exploded perspective view of a tufted carpet product with no woven secondary backing in place.
Figure 2:
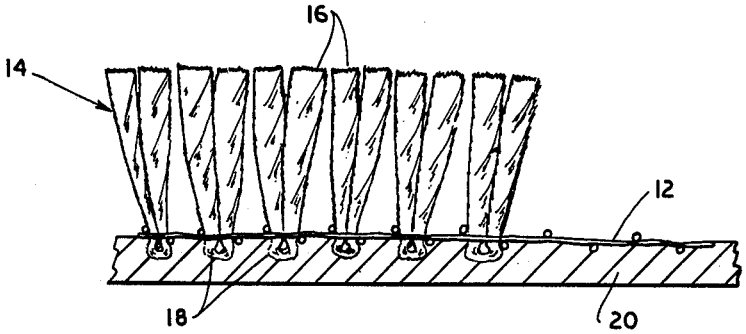
FIG. 2 is a side elevational view of a tufted carpet product including an integral secondary backing layer of carpet construction composition.
Figure 3:
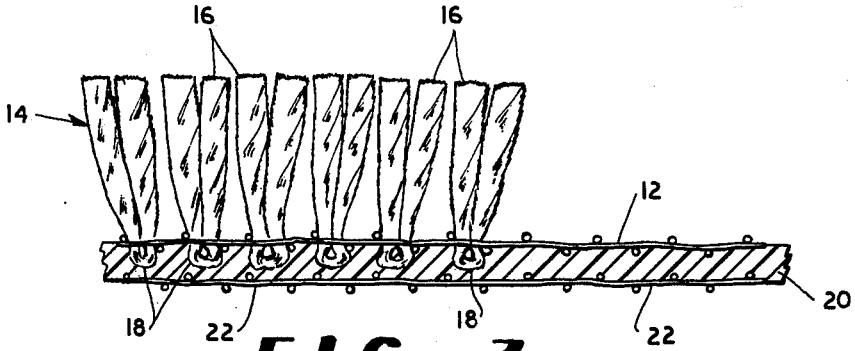
FIG. 3 is a side elevational view of a tufted carpet product including a woven secondary backing.

With particular reference to the drawings and in accordance with the present invention a tufted carpet product 10 is provided. The carpet product 10 consists of a woven primary backing material 12 and rows of carpet yarn 14 stitched into the primary backing. The stitching operation produces a product having a face 16 wherein the majority of the carpet yarn is exposed to provide the work surface of the carpet product. The product also has an undersurface with rows of tuft loop backs 18 protruding through the primary backing to only a slight degree. The tuft loop backs and the undersurface of the carpet product in general are coated with a liquid carpet construction adhesive composition 20 which retains the loop backs in place. If sufficient carpet construction composition is employed to produce a rather thick and uniform back coating, the carpet product is finished by the back coating operation. Normally, however, a second layer of backing material is adhered to the carpet product by placing a layer of material such as a secondary woven backing 22 on the carpet construction composition before the composition has set, see FIG. 3.

In any event, it should be clearly understood that conventional tufted carpet floor covering materials include at least a primary backing material, carpet yarn stitched into the primary backing material and a layer of carpet construction composition adhering the yarn to the primary backing. Conventional tufted carpet is prepared from both natural and synthetic and woven and non-woven primary backing materials. In addition the carpet yarn of conventional tufted carpet is manufactured from many natural and synthetic materials such as wool, cotton, nylon, polyester, polyolefin materials and blends thereof and the like.

The present invention is specifically concerned with carpet construction composition 20 and with a self-sanitizing additive mixed with carpet construction composition 20 prior to its distribution on the undersurface of the carpet product. It has been found that the self-sanitizing additive migrates through the carpet construction composition after that composition has set and the carpet has been installed. The additive migrates to the surface of the composition and then travels upwardly along the fibers of the face yarn by a wicking action at a rate sufficient to maintain a level of concentration on the face yarn that will kill or inhibit the growth of a wide spectrum of bacteria and other organisms. Growth of the following organisms, including both Gram-negative and Gram-positive bacteria, has been found to be inhibited by the present self-sanitizing additive material: *sarcina lutea, staphylococcus aureus,*

*staphylococcus albus, pseudomonas aeruginosa, escherichia coli, klebsiella, candida albicans, salmonella chloreasius, enterobacter aerogenes, escherichia communior, streptococcus pyogenes.*

The sanitizing additive of the present invention is a nonionic trialkyl amine and a Group II-A or Group II-B (from the Periodic Table) metal salt of a monocarboxylic acid having a carbon chain length of 1 to 4. Suitably, the trialkyl amine includes two alkyl groups which have a carbon chain length of 1 to 4 atoms and one alkyl group which has a carbon chain length of 8 to 18 atoms. Preferably, the trialkyl amine is a dimethylalkyl amine wherein the alkyl group has from 10 to 14 carbon atoms. The most preferred amine in this invention is dimethyllaurylamine.

Suitably, the Group II-A or Group II-B metal salt of a monocarboxylic acid includes the barium, cadmium and strontium salts or acetic acid, propionic acid and butyric acid. The most preferred of these salts is barium acetate.

The most preferred sanitizing additive is a mixture of dimethyllaurylamine and barium acetate in a part by weight ratio range of 1:1000 to 1000:1 for acetate to amine. A preferred part by weight ratio range for acetate to amine is 1:2 to 2:1. A most preferred part by weight ratio is 60 parts amine to 40 parts acetate.

When blending the additive into the carpet construction composition, a suitable concentration is 0.1% to 10% of additive in the carpet construction composition by weight. A preferred concentration is 0.5% to 9% and a particularly preferred concentration is 1% to 7% by weight.

In preparing the amine-acetate sanitizing additive for incorporation into a carpet construction composition, a mixture of dimethyllaurylamine and barium acetate is most preferred. Granular barium acetate, of a particle size of approximately minus mesh 4 (U.S. Standard Screen Size), is added to an oily liquid dimethyllaurylamine in a part by weight ratio as previously discussed in a ball mill. The ball mill tumble-mixes and grinds the mixture to a point where the particle sizes of the granular barium acetate are reduced sufficiently for the barium acetate to remain in suspension in the amine. Generally speaking, the acetate is reduced from minus 4 mesh to minus 325 mesh in the ball milling operation.

After preparation of the sanitizing additive, it is intimately mixed with the carpet construction composition prior to distribution of the carpet construction composition onto the undersurface of a tufted carpet.

The carpet construction composition of this application includes those conventional compositions normally employed in carpet construction such as natural and synthetic latex emulsions, hot melts of polyvinylchloride, polyethylene, polypropylene, and polyesters, aqueous solutions of polymers such as polyvinyl acetate, and like compositions.

Synthetic latex emulsions are most commonly employed as the carpet construction composition. Such emulsions normally include the following:

1. Polymer
2. Water
3. Emulsifiers
4. Initiator residue from emulsion polymerization reaction
5. Typical fillers, pigments, flame retardants and stabilizers Conventional polymers for synthetic latex emulsions include styrene-butadiene rubber, acrylonitrile-butadiene-styrene rubber (ABS), polyvinyl acetate, polyvinyl chloride, polyisoprene and the like. Conventional natural latex emulsions are prepared from the natural rubbers. In conventional latex emulsions the liquid material is 40–50% by weight solid materials and the remainder water.

It has been found that when incorporating the present additive into a conventional synthetic latex emulsion that the additive must be compatible with the emulsifier. Consequently, when preparing the present sanitizing carpet construction material it is desirable that the emulsifier in the latex emulsion be compatible with the additive.

Of the available emulsifiers it has been determined that nonionic and cationic emulsifiers generally provide suitable results and that nonionic emulsifiers normally produce satisfactory and desirable results.

A large number of commercial nonionic emulsifiers are selected from a family of high molecular weight alkyl, aryl, or alkyl-aryl groups attached to an ethylene oxide chain. The hydrophilic-lipophilic balance for these compounds can be varied by changing the ratio of the hydrophilic ethylene oxide units to the lipophilic hydrocarbon units of the molecule. Typical examples of nonionic emulsifiers are the alkyl aryl polyether alcohols such as:

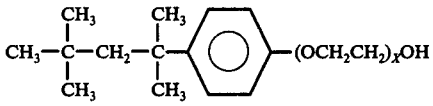

wherein X ranges from 1 to 40. Other examples of nonionic emulsifiers are the alkyl polyether alcohols such as:

$$C_{14\text{-}17}H_{29\text{-}35}(OCH_2CH_2)_XOH$$

wherein X ranges from 1 to 40. The hydrocarbon chain and ethenoxy units are varied to provide a wide range of products with variations in the hydrophilic-lipophilic balance.

Typical examples of cationic emulsifiers include the quaternary ammonium salts such as:

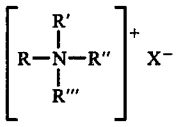

wherein R is straight chain $C_{12}$- $C_{18}$ and R', R'', and R''' are various combinations of methyl, ethyl, benzyl, and other similar groups. X is normally a halide.

As an example of the sanitizing capability of the present additive, thermoplastic discs were prepared with the additive incorporated therein the discs were exposed to bacteria according to the following example.

EXAMPLE I

To 90 parts of polyethylene pellets is added 10 parts of a sanitizing additive comprising equal amounts of dimethyllaurylamine and barium acetate. The pellets are coated with the oily suspension by tumbling mixing for 20 minutes. The coated pellets are fused in test tubes immersed in an oil bath at a temperature of 190° C. to 202° C. for 20 minutes. Upon subsequent cooling to ambient temperature, the plastic cylinders from the test tubes are removed and sawed into discs approximately 10 mils in thickness. No degradation of the polyethylene is noted. The discs are placed within appropriately impregnated petri dishes containing a nutrient agar. It is found upon incubation of the dishes that the discs inhibit the growth of bacteria and fungi around the discs and create a zone of inhibition. The results for the listed organisms are as follows:

TABLE A

| Organism: | Zone of inhibition in ml. |
|---|---|
| *Sarcina leutea* | (1) |
| *Staph. aureus* | 11 |
| *Pseudomonas aeruginosa* | 5 |
| *E. coli* | 5 |
| *Klebsiella* | 18 |
| *Candida albicans* | 8 |
| *Salmonella choleraesius* | 35 |

1 Complete inhibition throughout petri dish.

A tufted carpet product was then prepared according to the following example.

EXAMPLE II

A tufted carpet product is prepared using nylon carpet yarn and standard jute primary and secondary woven backing materials. The carpet construction composition is a commercially available styrene-butadiene latex emulsion. The composition includes 1% by weight based on the total weight of the composition of an additive mixture of 0.1% barium acetate and 99.9% dimethyllaurylamine by weight. Following construction of the carpet product, the product is installed in a corridor of a large metropolitan hospital. The carpet product was tested over a period of several months and found to be free of viable bacteria.

The self-sanitizing carpet construction composition of this invention includes a uniform dispersion of the sanitizing additive. One of the more interesting and important features of the composition is its ability to release the sanitizing additive uniformly through its surface and to replace the sanitizing additive when the surface concentration of the additive has been reduced. The additive migrates through the body of the composition to replenish the supply of additive on the surface of the composition to assure a long lasting surface concentration of additive which may be picked up by the carpet yarn to inhibit bacteria and other similar organism growth. Studies have shown that when a plastic article is manufactured with the additive included in the plastic, wiping or washing the article with soaps and detergents does not destroy the antibacterial capability of the article.

It should be understood that the applicants recognize that it would also be possible to incorporate the present sanitizing additive into the carpet yarn by blending the additive into the molten mass from which carpet fibers are spun in a conventional spinerette. The sanitizing additive could also be added to the molten mass from which films are manufactured for subsequent slitting or fracturing into solid strands of carpet face yarn.

While this invention has been described in detail with particular reference to preferred embodiments thereof, it will be understood that variations and modifications can be effected within the spirit and scope of the invention as described hereinbefore and as defined in the appended claims.

What is claimed is:

1. In a tufted carpet product including a primary backing sheet material, rows of carpet yarn stitched into the primary backing material to produce a face of yarn on one side of the backing and tuft loop backs of yarn on the opposite underside of the backing, and a layer of carpet construction adhesive on the tuft loop backs and on the underside of the backing, the improvement comprising a sanitizing additive blended with the carpet construction adhesive, said additive comprising a mixture of a nonionic trialkyl amine and a Group II-A or Group II-B metal salt of a monocarboxylic acid having a carbon chain length of 1 to 4.

2. Tufted carpet product of claim 1 wherein the sanitizing additive comprises a mixture of dimethyllaurylamine and barium acetate.

3. Tufted carpet product of claim 2 wherein the additive is present in the adhesive in a concentration of between 0.10% and 10% by weight.

* * * * *